US009720354B2

(12) United States Patent
Juri et al.

(10) Patent No.: US 9,720,354 B2
(45) Date of Patent: Aug. 1, 2017

(54) INTERMEDIATE TRANSFER BELT

(71) Applicants: Keiichiro Juri, Kanagawa (JP); Hideaki Yasunaga, Tokyo (JP); Akira Izutani, Osaka (JP); Makoto Matsushita, Tokyo (JP); Ayano Momose, Tokyo (JP)

(72) Inventors: Keiichiro Juri, Kanagawa (JP); Hideaki Yasunaga, Tokyo (JP); Akira Izutani, Osaka (JP); Makoto Matsushita, Tokyo (JP); Ayano Momose, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 24 days.

(21) Appl. No.: 14/731,556

(22) Filed: Jun. 5, 2015

(65) Prior Publication Data

US 2016/0004191 A1 Jan. 7, 2016

(30) Foreign Application Priority Data

Jul. 2, 2014 (JP) ..... 2014-136726

(51) Int. Cl.
*G03G 15/01* (2006.01)
*G03G 15/16* (2006.01)

(52) U.S. Cl.
CPC ..... *G03G 15/162* (2013.01); *G03G 15/0189* (2013.01); *G03G 15/1605* (2013.01); *G03G 15/1685* (2013.01)

(58) Field of Classification Search
CPC ..... G03G 15/0189; G03G 15/1605; G03G 15/1685; G03G 15/162
See application file for complete search history.

(56) References Cited

U.S. PATENT DOCUMENTS

| | | | | |
|---|---|---|---|---|
| 6,044,243 | A * | 3/2000 | Hara | G03G 15/162 399/302 |
| 2006/0204882 | A1 | 9/2006 | Nozaki et al. | |
| 2006/0275686 | A1 | 12/2006 | Kadota et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0238042 | A1 | 10/2007 | Yasunaga et al. | |
| 2008/0038656 | A1 | 2/2008 | Yasunaga et al. | |
| 2008/0063957 | A1 | 3/2008 | Murakami et al. | |
| 2008/0069594 | A1 | 3/2008 | Izutani | |
| 2008/0069598 | A1 | 3/2008 | Murakami et al. | |
| 2008/0069599 | A1 | 3/2008 | Nakamura et al. | |
| 2008/0069605 | A1 | 3/2008 | Fuwa et al. | |

(Continued)

FOREIGN PATENT DOCUMENTS

| | | |
|---|---|---|
| JP | 2004-198710 | 7/2004 |
| JP | 2009-063902 | 3/2009 |

*Primary Examiner* — Joseph S Wong
(74) *Attorney, Agent, or Firm* — Cooper & Dunham LLP

(57) ABSTRACT

An intermediate transfer belt for use in electrophotography is provided. The intermediate transfer belt includes a thermoplastic resin having a vinylidene difluoride (VdF) structure. The intermediate transfer belt has a degree of crystallinity in the range of 17% to 39%.

9 Claims, 1 Drawing Sheet

(56) References Cited

U.S. PATENT DOCUMENTS

2008/0069608 A1 3/2008 Katoh et al.
2008/0070149 A1 3/2008 Kato et al.
2008/0153018 A1 6/2008 Mikuriya et al.
2008/0159777 A1 7/2008 Fuwa et al.
2008/0175630 A1 7/2008 Yasunaga et al.
2008/0199234 A1 8/2008 Hagi et al.
2008/0226356 A1 9/2008 Yasunaga et al.
2008/0226997 A1 9/2008 Nakamura et al.
2008/0227009 A1 9/2008 Fuwa et al.
2008/0232849 A1 9/2008 Izutani et al.
2008/0232864 A1 9/2008 Izutani et al.
2008/0233506 A1 9/2008 Hagi et al.
2008/0279591 A1 11/2008 Yasunaga et al.
2008/0304875 A1 12/2008 Katoh et al.
2009/0041511 A1 2/2009 Fuwa et al.
2009/0052952 A1 2/2009 Katoh et al.
2009/0060540 A1 3/2009 Matsushita et al.
2009/0117481 A1 5/2009 Yasunaga et al.
2009/0142107 A1 6/2009 Akira et al.
2009/0169270 A1 7/2009 Fuwa et al.
2009/0180791 A1 7/2009 Matsushita et al.
2009/0186289 A1 7/2009 Nakamura et al.
2009/0186291 A1 7/2009 Mikuriya et al.
2009/0190949 A1 7/2009 Hamahashi et al.
2009/0238585 A1 9/2009 Hayashi et al.
2009/0257792 A1 10/2009 Nakamura et al.
2009/0279909 A1 11/2009 Matsushita et al.
2009/0324270 A1 12/2009 Yamashita et al.
2010/0009282 A1 1/2010 Katoh et al.
2010/0055603 A1 3/2010 Nozaki et al.
2010/0167196 A1 7/2010 Hagi et al.
2010/0272481 A1 10/2010 Yamamoto et al.
2010/0296848 A1 11/2010 Yamamoto et al.
2011/0008069 A1 1/2011 Matsushita et al.
2011/0217653 A1 9/2011 Izutani et al.
2011/0243616 A1 10/2011 Nakagawa et al.
2011/0249994 A1 10/2011 Matsushita et al.
2012/0237270 A1 9/2012 Juri et al.
2012/0294657 A1 11/2012 Matsushita et al.
2013/0058685 A1 3/2013 Juri et al.
2014/0212184 A1 7/2014 Juri et al.
2014/0243465 A1 8/2014 Matsushita et al.
2014/0321888 A1 10/2014 Yasunaga et al.
2015/0014602 A1 1/2015 Matsushita et al.
2015/0078777 A1 3/2015 Juri et al.
2015/0078790 A1 3/2015 Ishikawa et al.
2015/0078791 A1 3/2015 Momose et al.

* cited by examiner

INTERMEDIATE TRANSFER BELT

CROSS-REFERENCE TO RELATED APPLICATIONS

This patent application is based on and claims priority pursuant to 35 U.S.C. §119(a) to Japanese Patent Application No. 2014-136726, filed on Jul. 2, 2014, in the Japan Patent Office, the entire disclosure of which is hereby incorporated by reference herein.

BACKGROUND

Technical Field

The present disclosure relates to an intermediate transfer belt for use in electrophotography.

Description of the Related Art

In an electrophotographic image forming apparatus, for the purpose of reliably obtaining high quality image, a toner image is formed on an intermediate transfer belt to establish a standard of toner concentration. Imaging conditions, such as developing condition, are controlled in accordance with the detected toner concentration. The toner concentration is detected by emitting light from light emitting diode or the like to the toner image portion and the surface of the intermediate transfer belt, and detecting a difference in reflective light quantity between the toner image portion and the surface of the intermediate transfer belt. The greater the reflective light quantity from the intermediate transfer belt, the greater the dynamic range with respect to detection of the toner image and the better detection accuracy. Accordingly, the intermediate transfer belt is required to have a high degree of surface glossiness.

Materials usable for the intermediate transfer belt include thermosetting resins, such as polyimide, and thermoplastic resins, such as polyetheretherketone (PEEK) and polyvinylidene difluoride (PVDF). Because of being high in unit price and poor in processability and productivity, polyimide adversely raises component cost.

On the other hand, thermoplastic resins are low in unit price and easily moldable by extrusion, which is advantageous. In extrusion molding of thermoplastic resins, melt viscosity of the resin and surface roughness of a mold in use have a great influence on the surface roughness, as well as glossiness, of the molded belt. It is already known that the molded belt can be more improved in glossiness by post-processing, such as polishing with a polishing film for forming a mirror surface or formation of a coating layer on its surface.

However, such post-processing for enhancing the glossiness adversely increases the number of processing steps and raises component cost to the level of polyimide without taking advantage of low-cost thermoplastic resins.

SUMMARY

In accordance with some embodiments of the present invention, an intermediate transfer belt for use in electrophotography is provided. The intermediate transfer belt includes a thermoplastic resin having a vinylidene difluoride (VdF) structure. The intermediate transfer belt has a degree of crystallinity in the range of 17% to 39%.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
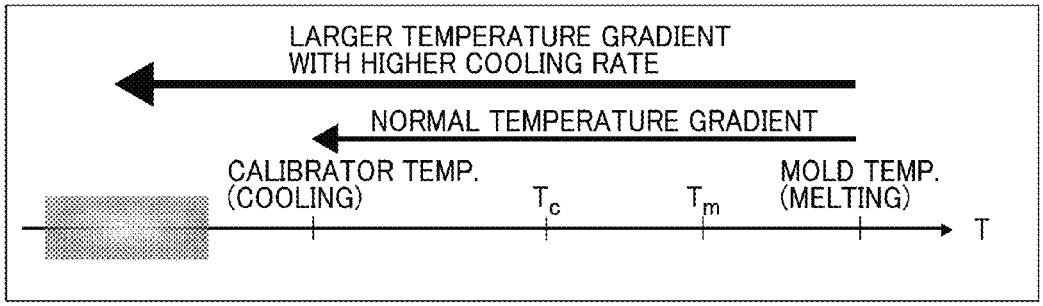
FIG. 1 is a schematic view for explaining a relation between the temperatures of a mold in contact with a molded product and a calibrator.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

One object of the present invention is to provide an intermediate transfer belt given a high glossiness without post-processing while taking advantage of good processability and low cost of thermoplastic resin.

A specific thermosetting resin having a low degree of crystallinity in a specific range is capable of giving glossiness to the extrusion-molded belt without post-processing such as polishing and coating.

In extrusion molding, materials in melt state flow out form a mold and pass through a calibrator while being cooled, thereby being molded into a tubular shape. Given a crystallization process of a polymer having a vinylidene difluoride structural site, the degree of crystallinity is determined by the time it takes to pass a crystallization temperature region in the process of transiting from melted state to solid state while being cooled. It is assumed that shortening of the transit time in the crystallization temperature region decreases the degree of crystallinity and increases the gloss. Accordingly, in actual extrusion molding, increasing the difference between the mold temperature (for melting) and the calibrator temperature (for cooling) can shorten the transit time in the crystallization temperature region, and as a result, the degree of crystallinity is decreased and the glossiness is increased.

Referring to FIG. 1, by reducing the calibrator temperature to make the difference between the calibrator temperature and the mold temperature greater, the transit time in the crystallization temperature region (Tc) is reduced. Accordingly, crystal growth is not accelerated and amorphous portions increase, thereby reducing the degree of crystallinity. As a result, the glossiness is increased.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Compound 1

A polyvinylidene difluoride (KYNAR® 721 from Arkema) in an amount of 87.5 parts and a carbon black (DENKA BLACK having an average primary particle diameter of 35 nm from Denki Kagaku Kogyo Kabushiki Kaisha) in an amount of 12.5 parts are dry-blended.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

In Table 1, X1 represents the addition amount of KYNAR® 721.

Compound 2

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-2

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-3

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-4

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-5

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-6

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 2-7

X1 parts of a polyvinylidene difluoride (KYNAR® 721 from Arkema), Y1 parts of a copolymer of vinylidene difluoride and hexafluoropropylene (KYNAR® 2751 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y1 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 3

X1 parts of a polyvinylidene difluoride (KYNAR® 721 from Arkema), Y2 parts of a copolymer of vinylidene difluoride and hexafluoropropylene (KYNAR® 2851 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y2 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 3-2

X1 parts of a polyvinylidene difluoride (KYNAR® 721 from Arkema), Y2 parts of a copolymer of vinylidene difluoride and hexafluoropropylene (KYNAR® 2851 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y2 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 3-3

X1 parts of a polyvinylidene difluoride (KYNAR® 721 from Arkema), Y2 parts of a copolymer of vinylidene difluoride and hexafluoropropylene (KYNAR® 2851 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y2 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 3-4

X1 parts of a polyvinylidene difluoride (KYNAR® 721 from Arkema), Y2 parts of a copolymer of vinylidene difluoride and hexafluoropropylene (KYNAR® 2851 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y2 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 3-5

X1 parts of a polyvinylidene difluoride (KYNAR® 721 from Arkema), Y2 parts of a copolymer of vinylidene difluoride and hexafluoropropylene (KYNAR® 2851 from Arkema), and 12.5 parts of a carbon black (DENKA BLACK having an average primary particle diameter of 35 nm from Denki Kagaku Kogyo Kabushiki Kaisha) are dry-blended. Specific numeral values for X1 and Y2 are described in Table 1.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

Compound 4

Y1 parts of a copolymer of vinylidene difluoride and hexafluoropropylene (KYNAR® 2751 from Arkema) and 12.5 parts of a carbon black (DENKA BLACK having an average primary particle diameter of 35 nm from Denki Kagaku Kogyo Kabushiki Kaisha) are dry-blended.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

In Table 1, Y1 represents the addition amount of KYNAR® 2751.

Compound 5

X2 parts of a polyetheretherketone (VICTREX® PEEK 450P from Victrex plc.) and 15.0 parts of a carbon black (DENKA BLACK from Denki Kagaku Kogyo Kabushiki Kaisha) are dry-blended.

The blended material is kneaded with a kneader at a temperature equal to or less than the melting point of the resin for 80 minutes. The kneaded material is subjected to a dispersion treatment of the carbon black, serving as a conductive agent, with double rolls for 30 minutes, and then pelletized with a pelletizer.

In Table 1, X2 represents the addition amount of PEEK 450P.

The above-prepared compounds are subjected to melt extrusion molding and formed into seamless intermediate transfer belts.

Example 1

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 2

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 3

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 4

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 5

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 6

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 7

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 8

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 9

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 10

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Example 11

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 1

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 2

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 3

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 4

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 5

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 6

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 7

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

Comparative Example 8

The pelletized compound is extrusion-molded into a belt shape having a thickness of T1 (described in Table 1) at a temperature of T2 (described in Table 1). The molded belt is passed through a calibrator at a winding speed described in Table 1 so as to have a temperature of T1 (described in Table 1).

TABLE 1

| | | Compound | X1 | X2 | Y1 | Y2 | T1 (° C.) | T2 (° C.) | Winding Speed (m/min) | Thickness (μm) | Degree of Crystallinity (%) | ΔH1/ΔH3 | H2/ΔH3 | Glossiness | Mechanical Strength |
|---|---|---|---|---|---|---|---|---|---|---|---|---|---|---|---|
| Examples | 1 | 1 | 87.5 | 0 | 0 | 0 | 110 | 50 | 0.8 | 200 | 39 | — | — | B | A |
| | 2 | 2 | 70.0 | 0 | 17.5 | 0 | 130 | 60 | 1.6 | 100 | 35 | 0.15 | — | B | B |
| | 3 | 2-2 | 60.0 | 0 | 27.5 | 0 | 120 | 55 | 1.4 | 120 | 30 | 0.35 | — | B | B |
| | 4 | 2-3 | 50.0 | 0 | 37.5 | 0 | 60 | 40 | 1.2 | 140 | 26 | 0.63 | — | B | B |
| | 5 | 2-4 | 40.0 | 0 | 47.5 | 0 | 80 | 50 | 0.9 | 180 | 20 | 0.80 | — | A | B |
| | 6 | 2-5 | 35.0 | 0 | 52.5 | 0 | 100 | 60 | 0.8 | 200 | 17 | 0.92 | — | A | A |
| | 7 | 3 | 60.0 | 0 | 0 | 27.5 | 130 | 60 | 1.4 | 120 | 34 | — | 0.41 | B | A |
| | 8 | 3-2 | 50.0 | 0 | 0 | 37.5 | 110 | 50 | 1.1 | 160 | 30 | — | 0.57 | B | A |
| | 9 | 3-3 | 40.0 | 0 | 0 | 47.5 | 105 | 60 | 0.9 | 180 | 25 | — | 0.72 | B | A |
| | 10 | 3-4 | 30.0 | 0 | 0 | 57.5 | 100 | 60 | 0.8 | 200 | 21 | — | 0.89 | A | A |
| | 11 | 3-5 | 25.0 | 0 | 0 | 62.5 | 80 | 50 | 1.2 | 140 | 18 | — | 0.99 | A | A |
| Comparative Examples | 1 | 1 | 87.5 | 0 | 0 | 0 | 110 | 50 | 1.2 | 140 | 47 | — | — | C | B |
| | 2 | 1 | 87.5 | 0 | 0 | 0 | 110 | 50 | 1.7 | 90 | 48 | — | — | C | C |
| | 3 | 2-6 | 30.0 | 0 | 57.5 | 0 | 95 | 45 | 0.9 | 180 | 16 | 0.93 | — | B | B |
| | 4 | 2-7 | 75.0 | 0 | 12.5 | 0 | 125 | 55 | 1.1 | 160 | 40 | 0.14 | — | C | B |
| | 5 | 3 | 60.0 | 0 | 0 | 27.5 | 90 | 60 | 1.2 | 140 | 42 | — | 0.40 | C | B |
| | 6 | 3-5 | 25.0 | 0 | 0 | 62.5 | 80 | 50 | 1.4 | 120 | 20 | — | 1.00 | A | C |
| | 7 | 4 | 0 | 0 | 87.5 | 0 | 100 | 50 | 0.7 | 210 | 14 | — | — | A | C |
| | 8 | 5 | 0 | 85.0 | 0 | 0 | 10 | 45 | 1.6 | 100 | 40 | — | — | C | C |

T1 = (Crystallization Temperature − Calibrator Temperature)
T2 = (Mold Temperature − Crystallization Temperature)
(Crystallization Temperature − Calibrator Temperature) > (Mold Temperature − Crystallization Temperature)

Measurement of Degree of Crystallinity

The degree of crystallinity is measured with a differential scanning calorimeter (DSC). Specifically, an instrument DSC 6200 from Seiko Instruments Inc. is used.

Figure 2:
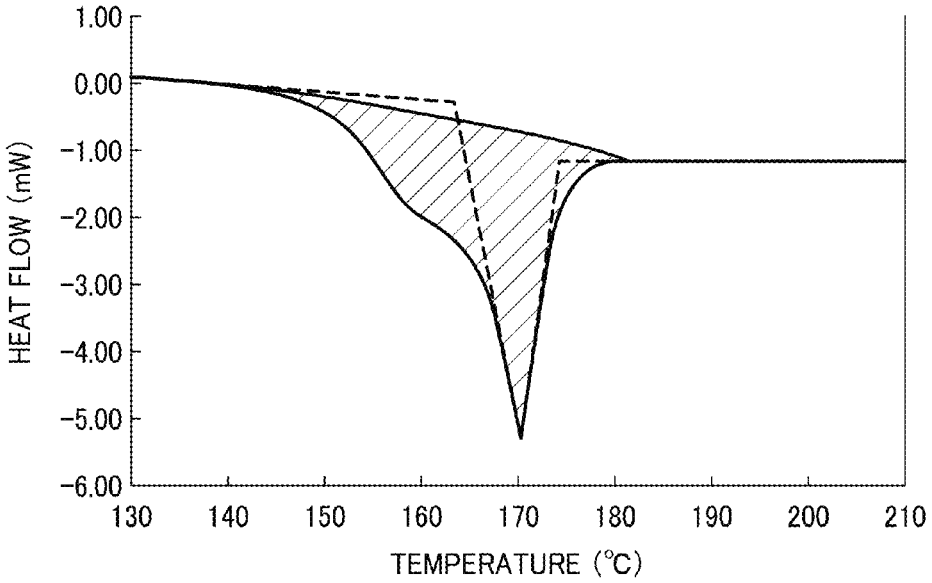
FIG. 2 is a schematic view for explaining a method of calculating the degree of crystallinity of a molded product using a DSC chart.

An extrusion-molded belt-like sample in an amount of 5 mg is weighed in an aluminum pan, set to the DSC instrument, and subjected to a measurement. In the measurement, the temperature is raised from room temperature to 200° C. at a rate of 10° C./min. The measurement result shows a relation between temperature and heat quantity, as illustrated in FIG. 2. An endothermic quantity is determined by integrating heat quantity differences with respect to temperature between the point where a heat quantity difference ΔH is generated and the point where ΔH becomes zero again. The endothermic quantity is represented by the shaded area in FIG. 2

The melting heat of perfect crystal of PVDF and PEEK is 93.1 mJ/mg and 130 mJ/mg, respectively. The degree of crystallinity is calculated using these values.

Measurement of ΔH1, ΔH2, and ΔH3

ΔH1, ΔH2, and ΔH3 are measured with a differential scanning calorimeter (DSC). The used instrument, amount of the sample, and temperature settings are the same as those in the measurement of degree of crystallinity.

ΔH1, ΔH2, and ΔH3 represent heat of crystal melting generated at temperature ranges of 130° C. to 138° C., 155° C. to 160° C., and 165° C. to 172° C., respectively, and calculated from the areas of endothermic peak.

Measurement of Glossiness

Glossiness is measured with an instrument GROSS CHECKER IG-320 from Horiba, Ltd.

The light source is an LED having a wavelength of 880 nm. The incidence angle and light-receiving angle are both 20 degrees.

Evaluation results in Table 1 are based on the following criteria.

A: Surface glossiness is not less than 60.

B: Surface glossiness is not less than 50 and less than 59.

C: Surface glossiness is less than 50.

Measurement of Mechanical Strength

Mechanical strength of an intermediate transfer belt is evaluated in terms of flex resistance.

Flex resistance is evaluated by a folding endurance test using an MIT type folding endurance tester. To conduct the folding endurance test under a condition as close as possible to the actual machine, the curvature radius of the folding surface of the folding clamp is set to 4.0 mm. The test is conducted under a load of 9.8 N and a folding angle of 135 degrees using a test specimen having width of 10 mm.

The number of times of folding until the test specimen fractures is defined as the number of times of folding endurance. In Table 1, mechanical strength is evaluated in terms of the number of times of folding endurance based on the following criteria.

A: Not less than 50,000 times.

B: Not less than 20,000 times and less than 50,000 times.

C: Less than 20,000 times.

What is claimed is:

1. An intermediate transfer belt for use in electrophotography, the intermediate transfer belt consisting of a single layer including a thermoplastic resin having a vinylidene difluoride (VdF) structure, wherein the intermediate transfer belt has a degree of crystallinity in the range of 17% to 21%, and wherein a surface of the single layer of the thermoplastic resin having the vinylidene difluoride (VdF) structure forms a surface of the intermediate transfer belt.

2. The intermediate transfer belt according to claim 1, wherein the thermoplastic resin includes polyvinylidene difluoride (PVdF).

3. The intermediate transfer belt according to claim 1, wherein the thermoplastic resin includes a copolymer of vinylidene difluoride (VdF) and hexafluoropropylene (HFP).

4. The intermediate transfer belt according to claim 1, wherein, when the intermediate transfer belt is subjected to a thermal analysis with a differential scanning calorimeter, a peak originated from heat of crystal melting is observed in each temperature range of 130° C. to 138° C., 155° C. to 160° C., and 165° C. to 172° C., and the following inequalities are satisfied:

$$0.15 \leq \Delta H1/\Delta H3 \leq 0.92$$

$$0.41 \leq \Delta H2/\Delta H3 \leq 0.99$$

wherein ΔH1, ΔH2, and ΔH3 represent amounts of heat of crystal melting in each temperature range of 130° C. to 138° C., 155° C. to 160° C., and 165° C. to 172° C., respectively.

5. The intermediate transfer belt according to claim 1, wherein the intermediate transfer belt has a glossiness of 50 or more when the glossiness is measured at incident and light-receiving angles of 20 degrees.

6. The intermediate transfer belt according to claim 1, wherein the intermediate transfer belt has a thickness in the range of 100 to 200 μm.

7. The intermediate transfer belt according to claim 1, wherein the number of times of folding endurance of the intermediate transfer belt is 20,000 times or more when measured under a load of 9.8 N by an MIT folding endurance test.

8. The intermediate transfer belt according to claim 1, wherein, when the intermediate transfer belt is subjected to a thermal analysis with a differential scanning calorimeter, a peak originated from heat of crystal melting is observed in each temperature range of 130° C. to 138° C., 155° C. to 160° C., and 165° C. to 172° C., and one of the following inequalities is satisfied:

$$0.80 \leq \Delta H1/\Delta H3 \leq 0.92$$

$$0.89 \leq \Delta H2/\Delta H3 \leq 0.99$$

wherein ΔH1, ΔH2, and ΔH3 represent amounts of heat of crystal melting in each temperature range of 130° C. to 138° C., 155° C. to 160° C., and 165° C. to 172° C., respectively.

9. The intermediate transfer belt according to claim 2, wherein the polyvinylidene difluoride (PVdF) accounts for 28.6% to 100% by weight of the thermoplastic resin.

* * * * *